United States Patent [19]

Federighi

[11] Patent Number: 4,791,834

[45] Date of Patent: Dec. 20, 1988

[54] PRESSURE METERING CORK EXTRACTOR

[76] Inventor: George J. Federighi, 70 - 13th St., San Francisco, Calif. 94103

[21] Appl. No.: 926,336

[22] Filed: Nov. 3, 1986

[51] Int. Cl.[4] ..... B67B 7/08

[52] U.S. Cl. ..... 81/3.2

[58] Field of Search ..... 81/3.2, 3.29, 3.45, 81/3.48

[56] References Cited

U.S. PATENT DOCUMENTS

| | | | |
|---|---|---|---|
| D. 197,983 | 4/1964 | Mourreau | D44/29 |
| 1,334,006 | 3/1920 | Welshausen . | |
| 1,471,427 | 10/1923 | Towle . | |
| 2,729,124 | 1/1956 | Farandatos | 81/3.2 |
| 2,892,576 | 6/1959 | Ward | 222/394 |
| 2,957,611 | 10/1960 | Sagarin | 222/394 |
| 2,971,509 | 2/1961 | Cohen | 128/216 |
| 3,036,744 | 5/1962 | Steinman et al. | 222/394 |
| 3,085,454 | 4/1963 | Federighi | 81/3.2 |
| 3,135,144 | 6/1964 | Cameron | 81/3.1 |
| 3,192,803 | 7/1965 | Federighi | 81/3.2 |
| 3,216,289 | 11/1965 | Lyman | 81/3.2 |
| 3,815,448 | 6/1974 | Artmer | 81/3.2 |
| 3,870,175 | 3/1975 | Dilanni | 214/304 |
| 4,317,390 | 3/1982 | Nakayama | 81/3.2 |
| 4,464,956 | 8/1984 | Hashimoto | 81/3.2 |

FOREIGN PATENT DOCUMENTS

| | | | |
|---|---|---|---|
| 588703 | 12/1959 | Canada . | |
| 692611 | 8/1964 | Canada | 81/3.2 |
| 3090 | 9/1983 | European Pat. Off. | 81/3.2 |
| 357928 | 9/1922 | Fed. Rep. of Germany . | |

*Primary Examiner*—Roscoe V. Parker

*Attorney, Agent, or Firm*—Harris Zimmerman; Howard Cohen

[57] ABSTRACT

A device for extracting corks from wine bottles or the like includes a body and pressurized fluid container, a hollow needle extending from the body for penetration through the cork and valve mechanism for selectively injecting pressurized fluid into the wine bottle through the needle to generate gas pressure which ejects the cork from the bottle. The valve mechanism has a metering action which injects a predetermined amount of pressurized fluid in response to each valve actuation thereby avoiding inadvertant over-pressurization of the bottle. Propellant fluid is also conserved to prolong periods between rechargings of the extractor. In a preferred embodiment, a shielding member restrains uncontrolled ejection of a cork and/or needle fragment which can otherwise occur if the needle is accidently broken during operation.

6 Claims, 2 Drawing Sheets

PRESSURE METERING CORK EXTRACTOR

TECHNICAL FIELD

This invention relates to apparatus for uncorking wine bottles or similar containers and more particularly to cork extractors of the type which operate by injecting pressurized fluid into a bottle or the like through the cork to accomplish the extraction.

BACKGROUND OF THE INVENTION

The deficiencies of the traditional corkscrew are well known to consumers of wine or other beverages that are marketed in corked bottles. Laceration of the cork rather than removal is a frequent occurrence. This often results in formation of a large passage through the cork that frustrates further efforts to withdraw the cork with the corkscrew. At best, use of a corkscrew requires an undesirable amount of physical effort.

These problems can be avoided by use of a pressurized fluid cork extractor. Such devices typically include a hollow needle of sufficient length that it may be penetrated through the cork, a container of pressurized gas or volatile liquid and a manually controlled valve which enables injection of fluid from the container into the bottle through the needle. Gas pressure then acts against the inner end of the cork in a manner which ejects it from the bottle.

Prior pressurized fluid cork extractors are somewhat demanding to operate as inadvertent injection of an excessive amount of pressurized fluid can result in an undesirably forcible ejection of the cork or even rupture of the bottle itself.

One prior form of cork extractor addresses this problem by providing a pressure relief valve at the gas flow passage that leads to the needle. The relief valve vents gas from the flow passage to the extent necessary to prevent the gas pressure in the bottle from rising above a predetermined upper limit. Such venting of gas to the atmosphere in order to avoid overpressures in the bottle accelerates the need for replacement of the gas charge in the extractor. If the operator occasionally or habitually holds the control valve open for a longer period than is actually necessary, a substantial portion of a given gas charge may be wasted rather than being productively utilized for its intended purpose of ejecting corks.

Replenishing the gas charge in a cork extractor involves significant costs and operational complication. It would be preferable to avoid over-pressures in the bottles without unproductively venting gas in the process.

Another problem arises in that the thin needle may be inadvertently broken during the gas injection operation. This can create a hazard as the needle and cork are no longer attached to the body of the extractor. The cork and needle or simply the needle itself may then be forcibly ejected in an uncontrolled manner by the gas pressure in the bottle. An extractor construction which inhibits such uncontrolled ejection of the cork and/or needle would be highly desirable.

The present invention is directed to overcoming one or more of the problems discussed above.

SUMMARY OF THE INVENTION

In one aspect, the invention provides a device for extracting a cork from a bottle or the like, the device having a needle proportioned for insertion through the cork and which has a fluid passage, a pressurized fluid container, a valve connected between the pressurized fluid container and the needle passage, and control means for selectively opening the valve to admit pressurized fluid from the container into the bottle through the needle passage. The valve is a metering valve having means for releasing only a predetermined volume of the pressurized fluid into the needle passage in response to each opening of the valve.

In another aspect, the invention provides a device for extracting a cork from a bottle or the like which includes a tubular body and a pressurized fluid container which is fitted into the body and is manually slidable relative to the body between a first position at which the container is spaced from the lower end of the body and a second position at which the container is closer to the lower end of the body. Spring means are present for urging the container towards the first position. A hollow needle extends downward from the lower end of the body and has an internal fluid passage with at least one outlet at the lower portin of the needle. A valve housing is secured to the lower end of the container and has an internal chamber with a fluid inlet at the upper end through which fluid from the container enters the chamber. A seal at the lower portion of the chamber has an opening and a valve member extends upward from the lower end of the body through the opening and into the chamber. The valve member has a fluid port located to be within the chamber when the container is at its second position and to be isolated from the chamber by the seal when the container is at its first position and also has a flow passage which communicates the port with the fluid passage of the needle. The upper portion of the valve member is proportioned to close the fluid inlet of the valve housing when the container is moved downward to the second position of the container.

In still another aspect, the invention provides a device for extracting a cork from a bottle or the like, the device having a body with a tubular end portion, a hollow needle extending from the end portion, a pressurized fluid container and valve means for selectively releasing fluid from the container into the bottle or the like through the needle after penetration of the needle through the cork. A shield member is secured to the body at the tubular end portion and has a diameter greater than that of the end portion, the shield member being shaped and positioned to extend laterally outward from the periphery of the body at the end portion.

Preferred embodiments of the invention avoid overpressurization of the wine bottle or the like without requiring an unproductive venting of propellant gas in order to accomplish that purpose. Metering valve structure releases only a predetermined optimum volume of pressurized fluid into the bottle in response to each actuation of the valve without regard to the period of time that the valve is held in the actuated state. This avoids undesirably forceable cork ejections and bottle ruptures while also maximizing the number of cork extractions which can be accomplished with a given charge of pressurized fluid. In the preferred form of the invention, a shield member is provided for restraining the otherwise uncontrollable ejection of a cork and/or needle fragment that can occur if the needle is accidently broken during operation of the extractor.

DETAILED DESCRIPTION OF THE PREFERRED EMBODIMENT

Figure 1:
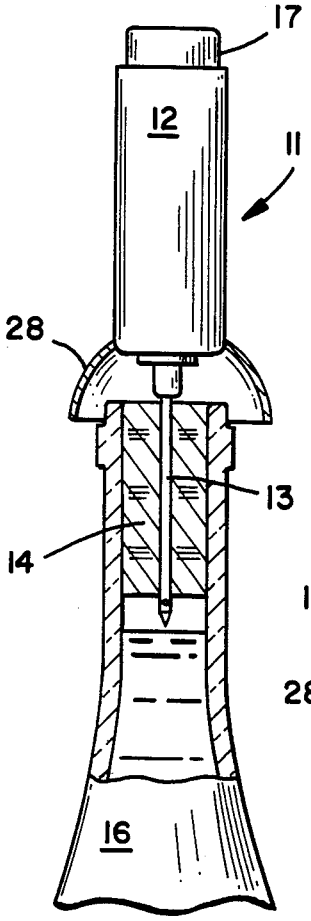
FIG. 1 is a side view of a cork extractor in accordance with a preferred embodiment of the invention, the extractor being shown emplaced at the cork of a wine bottle and with portions of the structure being in section.

Referring initially to FIG. 1 of the drawings, a cork extractor 11 in accordance with this embodiment of the invention includes a tubular body 12 and a hollow needle 13 which extends downward from the center of the lower end of the body, the needle being of sufficient length that it may be penetrated through the cork 14 of a wine bottle 16 or the like.

Figure 2:
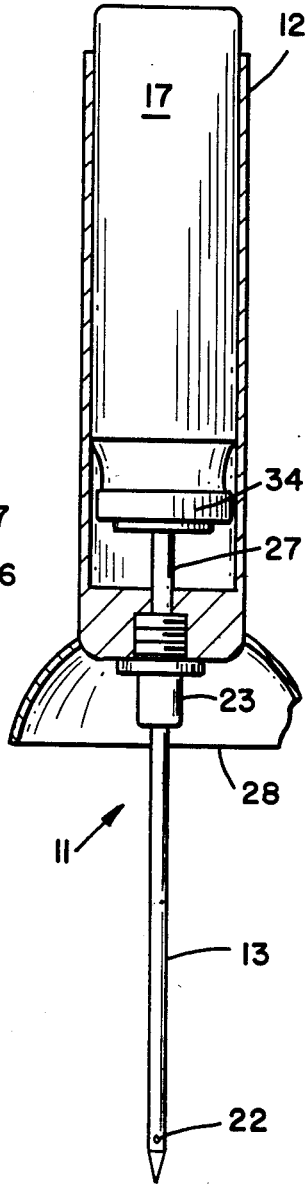
FIG. 2 is a larger side view of the cork extractor of FIG. 1 with the body member and shielding means shown in section.

Referring to FIG. 2, a closed cylindrical pressurized fluid container 17 is fitted into body 12 in coaxial relationship with the body. The container 17 is slidable relative to the body 12 and is proportioned to extend a small distance above the body as the extractor 11 is actuated by grasping the body with the fingers of one hand while depressing the container with the thumb as will hereinafter be described in more detail.

Figure 3:
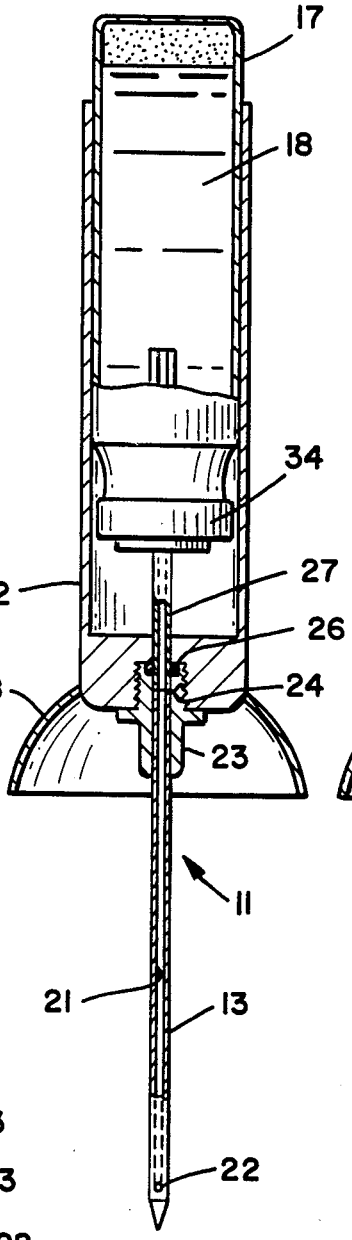
FIG. 3 is a full elevation section view of the cork extractor of the preceding figures.

With reference to FIG. 3, the pressurized fluid 18 within container 17 is a volatile liquid having a boiling point below room temperatures, liquified Freon gas being one suitable example. Liquids of this type vaporize upon being released from a closed container 17 into a wine bottle and cause a pressure increase in the wine bottle in the process. The fluid 18 may also be a compressed gas having a higher boiling point, such as carbon dioxide for example, that remains in the gaseous phase while confined in the container 17. In either case, the pressurized fluid or propellant 18 should be a nontoxic substance and one which does not detract from the quality of the wine.

As depicted in FIG. 3, pressurized fluid 18 of the volatile liquid type that is confined in a closed container 17 forms into a first volume of liquid at the lower region of the container and a second volume of the fluid in gaseous form situated at the upper region of the container.

A metering control valve 19, which will hereinafter be described, releases a predetermined volume of the pressurized fluid 18 through needle 13 in response to each depression of the container 17.

Figure 4:
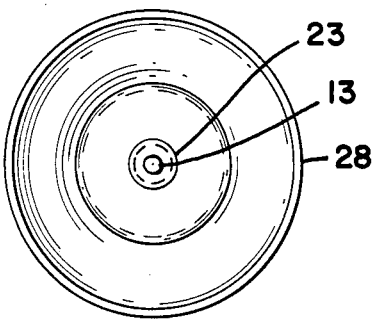
FIG. 4 is a bottom view of the cork extractor of the preceding figures.

Referring to FIGS. 3 and 4 in conjunction, the needle 13 has an internal passage 21 with an outlet opening 22 situated near the pointed lower end of the needle. A threaded collar 23 at the upper end of needle 13 engages in a threaded opening 24 in the base of body 12 to secure the needle to the body. Collar 23 also contains an O-ring 26 through which a tubular valve member 27 extends to transmit fluid 18 from valve 19 to the internal passage 21 of needle 13, the valve member being hereinafter described in more detail.

In order to block the unrestrained ejection of the cork and/or a needle fragment in the event of needle breakage during operation, an annular shield member 28 is secured to the lower end of body 12 in coaxial relationship therewith. The shield 28 has a diameter greater than that of body 12 and thus extends laterally outward from the body, the shield preferably being downwardly curved towards the periphery of the shield so that it effectively covers the cork 13 and the mouth of bottle 16 when the extractor 11 is in operation as depicted in FIG. 1.

Figure 5:
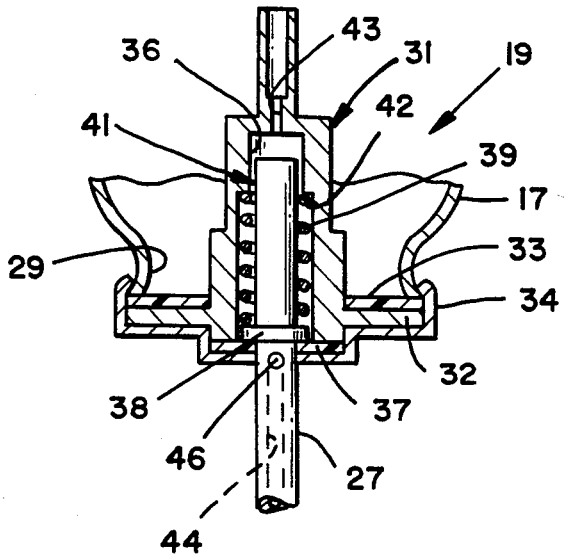
FIG. 5 is a section view of metering valve structure of the cork extractor shown in the closed position.
Figure 6:
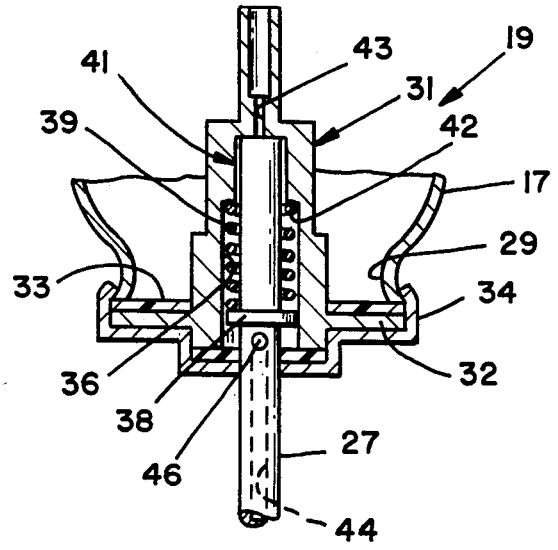
FIG. 6 is a section view of the metering valve structure of FIG. 5 shown in the open position of the valve.

Referring jointly to FIGS. 5 and 6, the metering control valve 19 is secured to the lower end of pressurized fluid container 17 and serves as a closure for the mouth 29 of the container which is at the lower end of the container, in addition to performing the valving functions. The valve housing 31 extends upward into the lower end of container 17 and has a flange 32 which abuts a gasket 33 that in turn abuts the rim of container mouth 29. A bottom end cap 34 is crimped around the peripheries of flange 32, gasket 33 and container mouth 29 to secure the valve 19 in place and to provide a sealed closure for the container 17.

Valve housing 31 has a stepped internal chamber 36 of circular cross section which is aligned along the axis of the container 17 and the previously described tubular valve member 27 extends up into the chamber through end cap 34 and a resilient annular seal 37 which is contained between the valve housing and end cap. Valve member 27 is provided with a flange 38 situated within chamber 36 and which is of smaller diameter than the chamber. A compression spring 39 is disposed coaxially on the upper portion 41 of valve member 27 and acts between flange 38 and an annular shoulder 42 within chamber 36 to urge the housing 31 and thus container 17 upwardly relative to the valve member. Upward movement of the housing 31 and container 17 under the influence of spring 39 is limited by abutment of flange 38 against seal 37.

Pressurized liquid from the lower region of container 17 is received in chamber 36 through an inlet tubulation which extends upward from housing 31 and which forms an inlet opening 43 of smaller diameter than upper portion 41 of valve member 27. The upper portion 41 of the valve member is proportioned to be spaced apart from opening 43 when flange 38 is abutted against seal 37 to enable entry of liquid 18 into chamber 36 at that time.

The internal passage 44 of valve member 27 has an inlet port 46 situated slightly below flange 38. Thus the inlet port 46 is isolated from chamber 36 when flange 38 is abutted against seal 37 as depicted in FIG. 5 in particular. Flange 38 is urged against seal 37 at that time both by spring 39 and by fluid pressure to thereby seal the chamber 36 against leakage into valve member 27 and the valve 19 is in the closed position.

In operation, with reference again to FIG. 1, needle 13 is penetrated through the cork 14 of bottle 16 and the operator then grasps body 12 of the extractor 11 with the fingers of one hand while depressing container 17 with the thumb of the same hand. Referring to FIG. 6, such depression of container 17 lowers valve housing 31, including end cap 34 and seal 37, relative to valve member 27. This lifts flange 38 relative to seal 37, compressing spring 39 in the process, and the inlet port 46 of valve member 27 is then exposed to the interior chamber 36 of the valve housing 31. The pressurized liquid within chamber 36 then escapes through valve member passage 44 and, with reference to FIG. 3, through needle passage 21. Referring to FIG. 1, the liquid expands in the region of bottle 16 below cork 14 generating gas pressure which urges the cork and the extractor 11 through needle 13 and is easily removed from the bottle 16 by lifting the extractor away from the bottle.

Referring again to FIG. 6, the downward movement of container 17 which actuates the extractor 11 is limited by abutment of the top chamber 36 against the top of valve member 27. As the valve member 27 has a greater diameter than the inlet opening 43 at the top of chamber 36, the inlet opening is then closed and additional liquid from container 17 cannot enter chamber 36 until the extractor 11 is deactuated. Consequently, each actuation of the extractor 11 releases only a predetermined amount of pressurized liquid, determined by the volume of chamber 36, without regard to how long the operator may hold the device in the actuated position shown in FIG. 6. Chamber 36 is proportioned to contain a volume of liquid sufficient to raise the cork but insufficient to cause an overly forcible ejection of the cork or to cause bottle rupture.

While the invention has been described with respect to a specific embodiment, many modifications of the structure are possible and it is not intended to limit the invention except as defined in the following claims.

I claim:

1. In a device for extracting a cork from a bottle or the like, the device having a needle proportioned for penetration through the cork and defining a fluid passage, a pressurized fluid container containing a first volume of said fluid in liquid form and a second volume of said fluid in gaseous form, said gaseous volume of said fluid being at the upper region of said container when said device including said container and said needle are in an upright operating orientation, a valve connected between the pressurized fluid container and the needle passage and control means for selectively opening the valve to admit pressurized fluid into the bottle through the needle passage, the improvement comprising:

said valve being a metering valve having means for releasing only a predetermined volume of said pressurized fluid into said needle passage in response to each opening of said valve, and wherein said valve has a fluid inlet situated within said first volume of fluid in when said device is at said upright operating orientation whereby said valve receives said fluid from said container in liquid form.

2. The apparatus of claim 1 wherein said valve includes a valve housing defining a fluid chamber which is communicated with a lower region of said pressurized fluid container when said valve is in the closed condition and said device is at said upright orientation, means for releasing fluid from said chamber into said needle passage when said valve is in the open condition, and means for blocking said communication between said chamber and said pressurized fluid container while said valve is in said open condition.

3. The apparatus of claim 1 further including a tubular body having said pressurized fluid container fitted therein, said container being slidable relative to said body between first and second positions, and wherein said valve has a housing secured to said container for movement therewith and which defines a fluid chamber with an inlet opening that communicates with the lower region of said container, and a valve member having an inlet port and an internal passage which communicates said inlet port with said needle passage which valve member extends into said fluid chamber, said port being located on said valve member to be out of communication with said fluid chamber when said container is at said first position thereof and to be communicated with said chamber when said container is moved to said second position thereof, said valve member being proportioned and positioned to block said fluid chamber inlet opening while said container is at said second position thereof.

4. The apparatus of claim 3 further including an annular resilient seal disposed at the opposite end of said fluid chamber from said inlet opening thereof in coaxial relationship with said inlet opening, and wherein said valve member is tubular and extends into said fluid chamber through said seal in coaxial relationship therewith, said valve member having a closed end which is spaced from said fluid chamber inlet opening when said container is at said first position thereof and which seats at said inlet opening and closes said opening when said container is moved to said second position thereof.

5. The apparatus of claim 3 wherein said valve member extends in coaxial relationship with said fluid chamber inlet opening and extends into said chamber through an end thereof that is opposite from said inlet opening, said valve member having a flange thereon which is located at said end of said chamber when said container is at said first position thereof, said valve housing having a shoulder in said chamber which is spaced apart from said inlet opening, further including a compression spring disposed on said valve member in coaxial relationship therewith within said chamber, said spring having first and second ends bearing against said flange and said shoulder respectively.

6. In a device for extracting a cork from a bottle or the like, the combination comprising:

a tubular body and a pressurized fluid container which is fitted therein and which is manually slidable relative thereto between a first position at which the container is spaced from the lower end of the body and a second position at which the container is closer to said lower end of said body a pressurized fluid within said container, including a first volume of said fluid which is in volatile liquid form and situated in a lower region of said container and a second volume of said fluid in gaseous form situated above said first volume of fluid, spring means for urging said container towards said first position thereof, a hollow needle extending downward from said lower end of said body, said needle having an internal fluid passage with at least one outlet at the lower portion of the needle, a valve housing secured to the lower end of said container and having an internal chamber and a fluid inlet located at the upper end of the chamber within said lower region of said container and through which liquid from said container enters said chamber, a seal at the lower portion of said chamber, said seal having an opening therethrough, and a valve member extending upward from said lower end of said body through said opening of said seal and into said chamber and having a fluid port located to be within said chamber when said container is at said second position thereof and to be isolated from said chamber by said seal when said container is at said first position thereof, said valve member having a flow passage which communicates said port with said fluid passage of said needle and having an upper portion which is proportioned to close said fluid inlet of said valve housing when said container is moved downward to said second position thereof.

* * * * *